United States Patent [19]

Hollweck

[11] Patent Number: 4,862,132

[45] Date of Patent: Aug. 29, 1989

[54] BIMETAL SWITCH

[75] Inventor: Walter Hollweck, Heroldsberg, Fed. Rep. of Germany

[73] Assignee: Inter Control Hermann Kohler Elektrik GmbH & Co. KG, Nuremberg, Fed. Rep. of Germany

[21] Appl. No.: 137,748

[22] Filed: Dec. 24, 1987

[30] Foreign Application Priority Data

Dec. 24, 1986 [DE] Fed. Rep. of Germany ..... 3644514

[51] Int. Cl.[4] ..... H01H 61/02; H01H 63/13

[52] U.S. Cl. ..... 337/102; 337/107

[58] Field of Search ..... 337/102–107

[56] References Cited

FOREIGN PATENT DOCUMENTS 2462013 3/1981 France ..... 337/102

*Primary Examiner*—H. Broome

*Attorney, Agent, or Firm*—Robin, Blecker, Daley & Driscoll

[57] ABSTRACT

A bimetal switch 1 has an insulating base 2 on which a contact spring 3 is arranged, this contact spring having at its unattached end 4 a moving contact 5. In its center area 6, the contact spring 3 supports the bimetal element that activates it. A fixed contact 8 that works in conjunction with the moving contact 5 is arranged on the insulating base and the heating resistor is installed beneath the center area 6 of the contact spring 3. In order to develop a bimetal switch of this kind such that it is simpler to produce and at the same time operates more effectively, the heating resistor 9 is configured as a foil resistor that is arranged on that side of the insulating base that faces the contact spring 3 so as to be flat and in thermal contact with the base, this then forming a laminated body with the insulating base 2.

9 Claims, 6 Drawing Sheets

BIMETAL SWITCH

Figure 1:
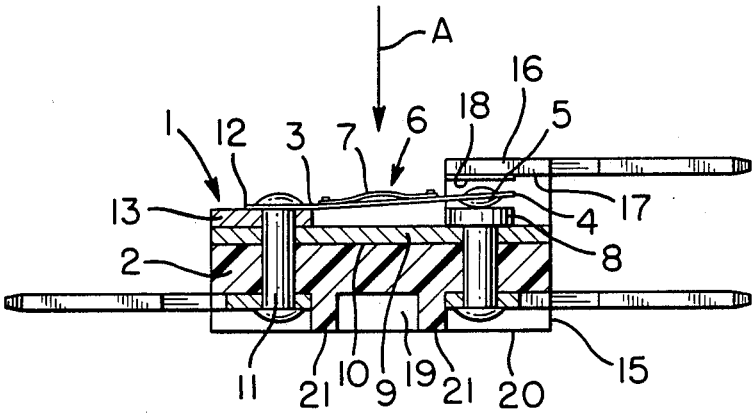

The present invention relates to a bimetal switch.

German utility patent No. G 86 17 033.3 describes a bimetal switch that consists essentially of a flat rectangular body of insulating material to which a plurality of electrical contact connecting lugs are connected. One side of the insulating body supports a contact spring that has a moving contact at its unattached end. The bimetal element is attached in the central area of the contact spring, and this determines the switch position of the contact spring, depending on whether it is curved in a convex or a concave shape (in reference to the relative position to the insulating body). A fixed contact that works in conjunction with the moving contact is also attached to the insulating body. The fixed contact is connected electrically with the fixed end of the moving contact through a heating resistor that is arranged beneath the contact spring, this being short circuited when the bimetal switch is closed and conducts current only when the contact spring is open.

The known bimetal switch is disadvantageous, in that the insulating body has to be provided with a recess for arranging and contacting the resistor, said recess then accommodating the resistor. The resistor is provided in the form of a block-shaped PTC resistor that is held between two spring elements that act on and contact this on its upper and lower sides. In addition, a large number of individual elements have to be installed in their final position before the rivets that hold the individual elements together can be installed. This entails a very high level of expenditure for machinery in the event that the switch is to be produced in an automated process. Furthermore, because of its relatively complex construction, a switch of this kind is sensitive and not entirely satisfactory as regards the reciprocity of its switching behaviour.

Thermal relays are also known, and these incorporate a plurality of resistors that can be connected to each other by various ways and means, which means that the known thermal relay can be used in a variety of applications.

It is the task of the present invention to so configure a bimetal strip that it is made simpler to produce and is capable of improved performance.

The basis of the present invention is that at least one heating resistor is not configured as a resistor that has to be installed and secured individually, but that it is installed on the side of the insulating body that supports it, that faces towards or away from the contact spring, in direct thermal contact with the insulating body. If the heating resistor is configured, in particular, as a film resistor and preferably arranged flat on one of the flat sides of the insulating body then, together with the insulating body, it forms a laminated body that, from the commercial point of view, can be very easily prefabricated.

This insulating body, with the heating resistor attached directly to it, can be upgraded in a relatively simple manner to become a bimetal switch in a variety of forms, used for a variety of functions. As an example, one heating resistor can be used as a self-holding heating resistor, if the bimetal switch is one with a self-holding feature. If, for example, the bimetal element is so arranged that the switch opens when the bimetal strip is cold and is closed when the bimetal strip is heated, the switch can be used as a temperature monitoring switch that interrupts a heating-current circuit, for example, by means of a switching element that is incorporated after it.

In particular, the heating resistor can be in the form of a thin-foil resistor or as a thick-foil resistor, it being essential in each case that, together with the insulating body, it forms a laminated body that can be prefabricated on a commercial basis (also as an NTC or as a PTC).

It is particularly advantageous if a plurality of heating resistors that form a laminated body together with the insulating body is provided, these being applied to the insulating body together during the production process and can then be separated from each other subsequently by a separating cut. It is, however, also possible to apply the two insulating foils together through a mask.

In an advantageous manner, the additional heating resistor is shorter than the first heating resistor and the connectors of these two heating resistors run parallel to each other and at right angles to the longitudinal direction of the heating resistors. This results in an arrangement of the heating resistors and the associated connector elements in the form of two U-shapes, one within the other, which saves a great deal of space and which is advantageous from the assembly point of view when the switch is used. A switch that is configured in this way can, for example, be soldered onto a circuit board, when the switch surfaces are perpendicular to the surface of the circuit board. When this is done, it is preferred that the connectors protrude beyond one edge of the insulating body and these can be inserted into the circuit board very conveniently during assembly. In order to further minimize the size of the switches it is also possible to arrange one resistor on the side of the insulating body that is closest to the contact spring and the other resistor on the side of the insulating body that is furthest from the contact spring.

In an advantageous manner the resistor foils extend into the area of the associated retaining rivets, which pass through the insulating body. One of the retaining rivets forms the fixed contact and serves simultaneously as a retainer for the first electrical connector, whilst the other retaining rivet holds the fixed end of the contact springs and holds the second electrical contact. The electrical contacts are flat plugs or lugs that protrude on both sides from the insulating body, or the soldering tags discussed above.

A further embodiment of the bimetal switch according to the present invention that is advantageous for those cases in which various applications, which is to say, in particular, differing temperature ranges and/or differing voltage ranges, are to be detected with one and the same switch, and switching behaviours that are as reproducible and the same as possible are to be achieved. In this regard, temperature ranges between −20° C. and +80° C. and voltage ranges from approximately 186 volts to 242 volts are to be understood, for example.

A special application of the bimetal switch according to the present invention is as a power divider.

It has been seen from the prior art that in specific applications power dividing diodes with equivalent half-wave power division are no longer reliable since this loads the network asymetrically, which is undesirable. This is avoided by the use of the bimetal switch according to the present invention as a power divider, which is to say that the bimetal switch represents an ideal replacement for power dividing diodes.

On the basis of the further development of the bimetal switch as below described one obtains a curvature of the bimetal strip that is reversed for practical purposes, which leads to the fact that the switch is open when cold and closed when hot. In the open state the heating resistor is effective and after a specific duty cycle-lead time this closes the switch, which means that the heating resistor itself becomes cold again, although the load is switched on. If, on the other hand, the heating resistor has cooled down to the point that the bimetal strip has also become cold again, the switch will open once again which means that the load is switched off and the whole cycle can begin again from the start. As an example, the cycling behaviour of this type of power division can be adjusted by the sequential switch-on and switch-off procedures with the help of a variation of the resistance value of the heating resistor. However, it is also possible to arrive at the desired cycling behaviour with the help of various bimetal discs, with the resistance value of the heating resistor remaining constant, and in particular to vary this cycling behaviour in the desired manner.

Alternatively, the cycling behaviour can also be adjusted in that the substrate, which is to say the insulating body, can be made relatively large, which is to say over-dimensioned, which results in a relatively high rate of thermal dissipation, and in that this insulating body is divided into two areas that are connected with each other through a nominal breakpoint, so that a first cycle time can be set for a complete insulating body and a second cycle time, which differs from the first, can be set for an insulating body that has been reduced by the separated area.

A further advantageous use of the bimetal switches according to the present invention is in the form of their multiple arrangement on a carrier.

Figure 2:
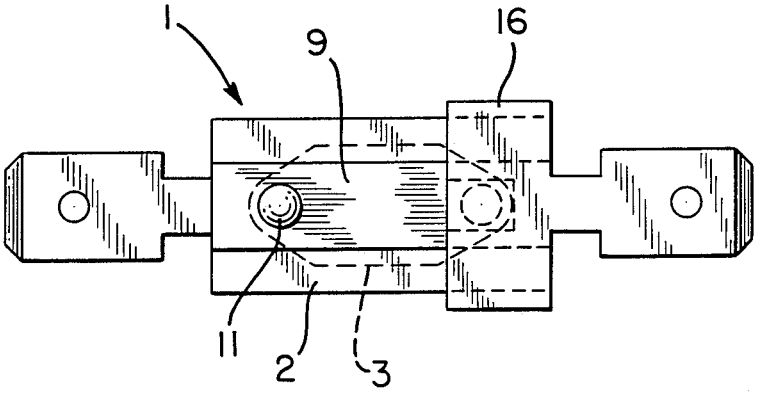
Figure 3:
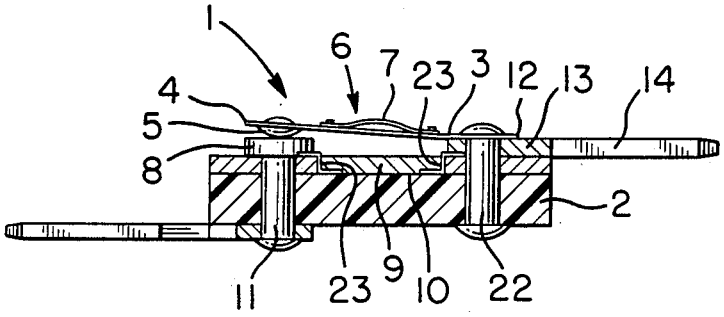
Figure 4:
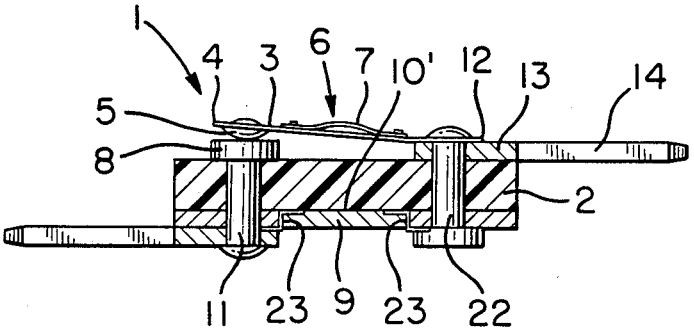
Figure 5:
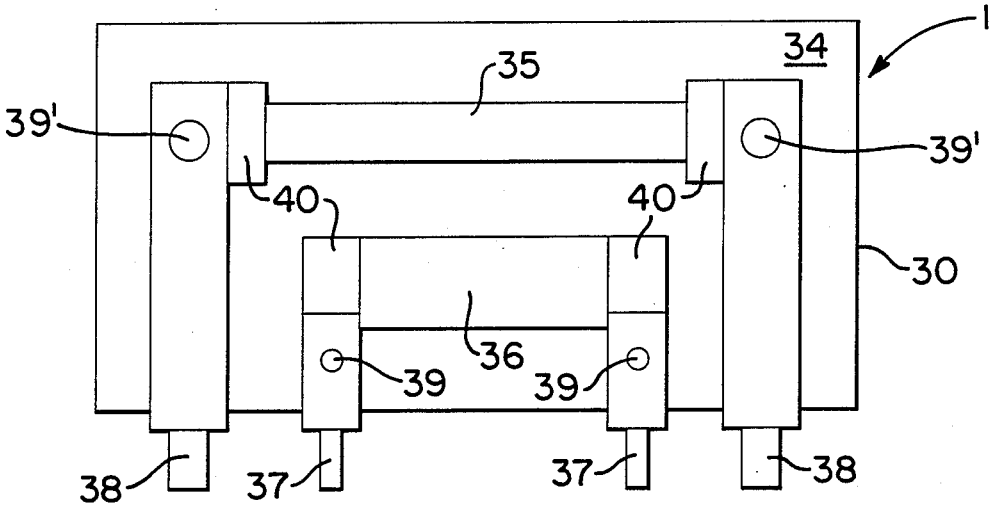
Figure 6:
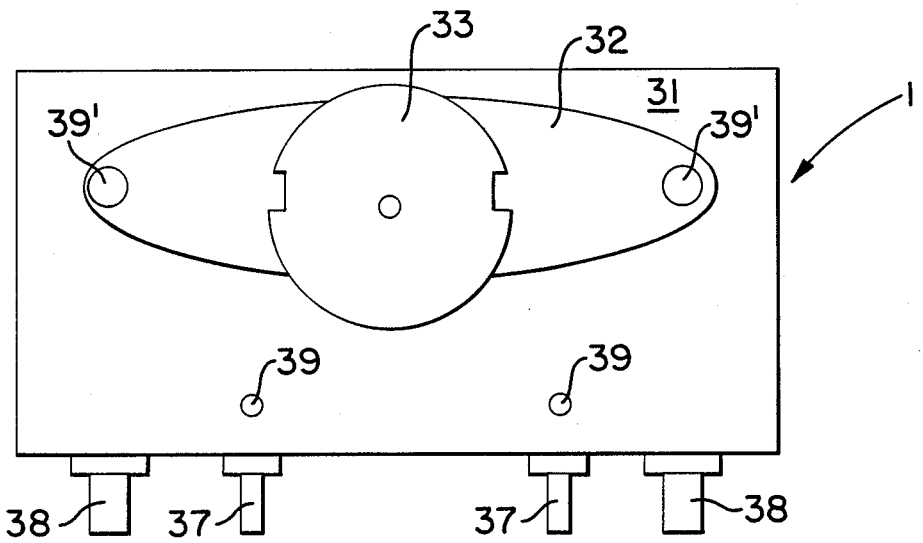
Figure 8:
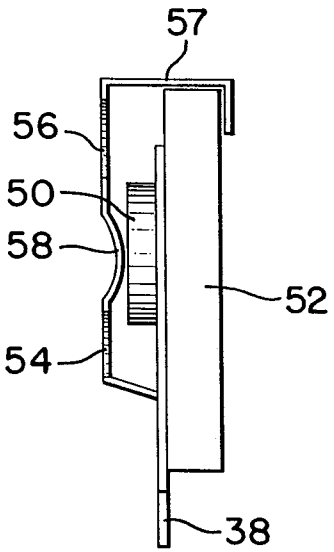
Figure 9:
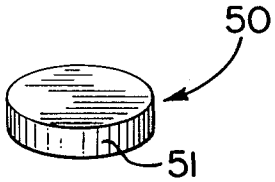
Figure 7:
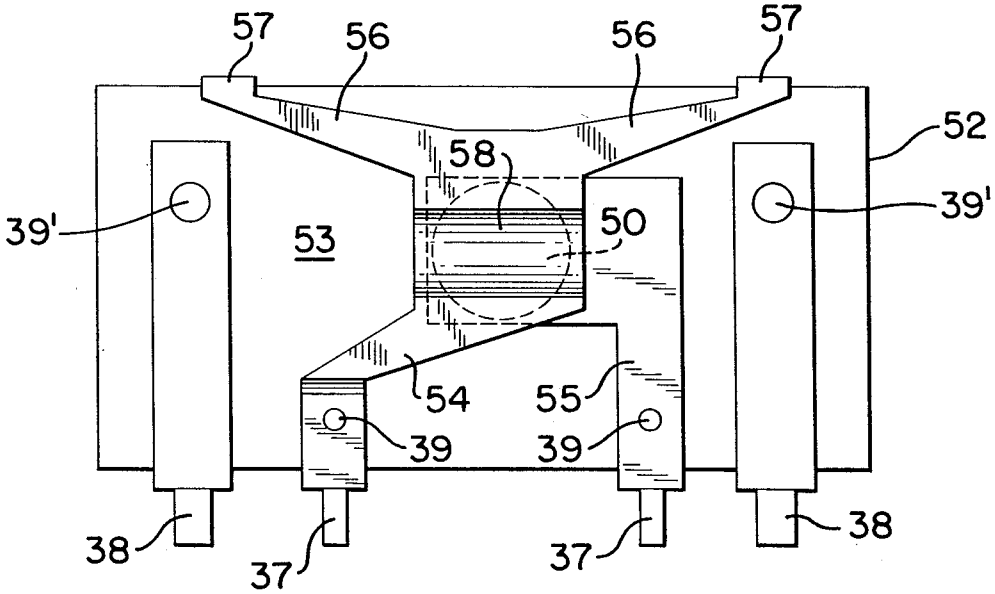
Figure 10:
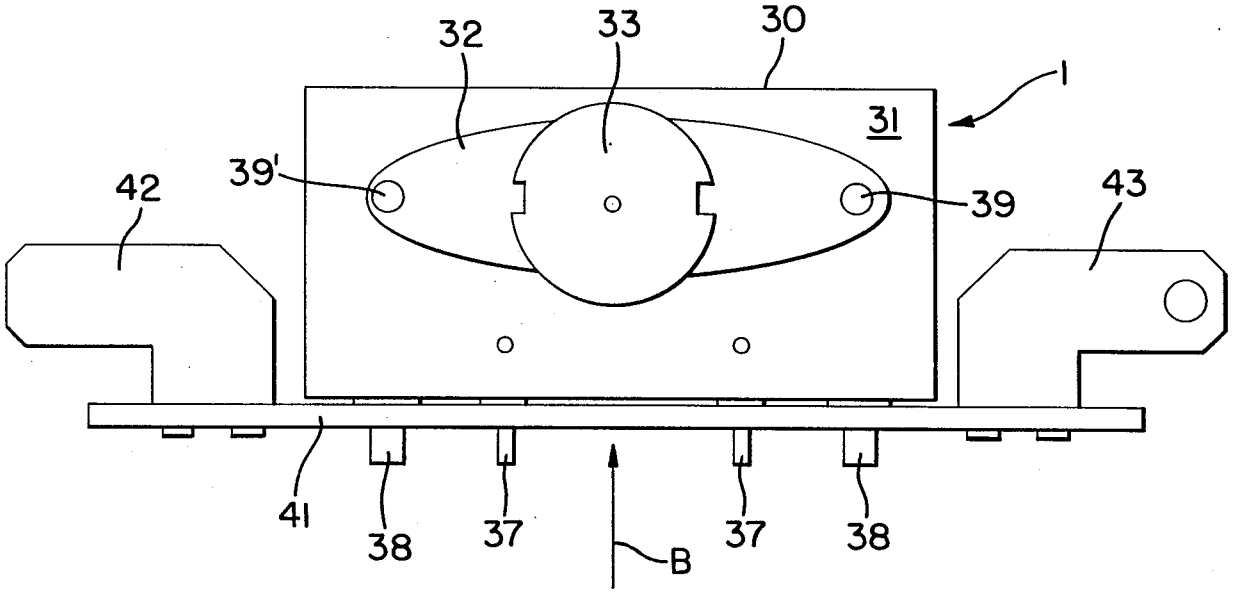
Figure 11:
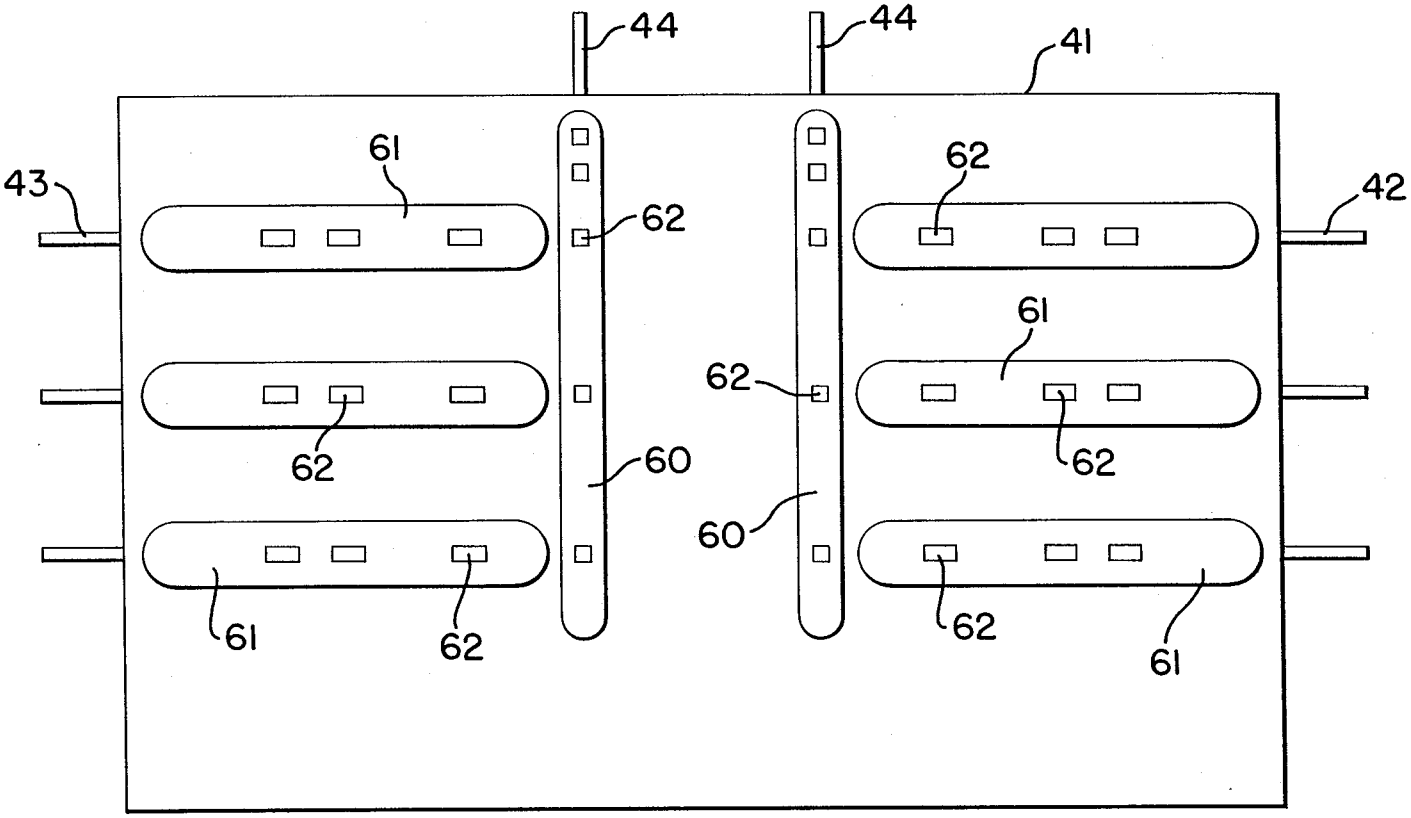

The present invention is described in greater detail below on the basis of several advantageous embodiments shown in the drawings appended hereto. These drawings show the following:

FIG. 1: a schematic representation of a first embodiment of a bimetal switch according to the present invention;

FIG. 2: a schematic plan view in the direction indicated by the arrow A as in FIG. 1;

FIG. 3: a further embodiment of a bimetal switch according to the present invention;

FIG. 4: a third embodiment of a bimetal switch according to the present invention;

FIGS. 5 and 6: a fourth embodiment of a bimetal switch according to the present invention, this being in front and rear view;

FIG. 7: a fifth embodiment of a bimetal switch according to the present invention, as viewed from the rear;

FIG. 8: a side view of a bimetal switch as in FIG. 7;

FIG. 9: an embodiment of a heating resistor in the form of a PTC resistor;

FIG. 10: a front view of an embodiment of a multiple arrangement of bimetal switches according to the present invention mounted on a carrier;

FIG. 11: a schematic view of the rear of the carrier of a multiple arrangement in the direction indicated by the arrow B as in FIG. 10.

The bimetal switch 1 that is shown in the drawings has an insulating body 2 to which is attached a contact spring 3 that has a moving contact 5 at its unattached end 4. A bimetal element 7 that is configured as a circular bimetal disc is attached to the central part 6 of this contact spring by clamping elements. In addition, a fixed contact 8 that is configured as a rivet head is also provided on the insulating body 2; this fixed contact 8 is connected electrically to the moving contact 5 when the contacts are in the closed position.

Beneath the center area 6 there is a heating resistor 9 which is configured as a film resistor and is arranged so as to be flat on the side of the insulating body that is remote from the contact spring 3, and in thermal contact with the insulating body 2 and which with the insulating body 2 forms a laminated body.

In the first embodiment, the heating resistor 9 essentially covers the whole of the side 10 of the base that is closest to the contact spring, and can be configured as a thin-foil resistor. As is also made clear by FIG. 1, the foil of the heating resistor extends beyond 9 both the fixed contact 8 as well as a further rivet 11 that secures the contact spring at its attachment end. Thus, in the embodiment shown, the resistor foil of the heating resistor 9 thus connects the fixed end 12 of the contact spring 3 electrically with the fixed contact 8. Essentially, the resistor foil is of equal thickness over its whole extent, i.e., the whole area of contact with the base side, and the resistor foil is of a greater area than the area of the contact spring, as is indicated by the dashed line in FIG. 2.

Between the fixed end 12 of the contact spring 3 and the resistor foil (heating resistor 9) there is a metal spacer, the thickness of which corresponds essentially to the height of the fixed contact 8. As can be seen from FIG. 3, the spacer 13 can be formed by the base-side end of a connector element that is in the form of a flat tab 14. Even though in FIG. 1 the resistor foil (heating resistor 9) is shown as being relatively thick, it is in fact only 2–20 microns thick, and has a heater output of approximately 0.5 W to 5 W; it can be applied by vaporization, sputtering, imprinting, grown on epidactically or coated on as a paste-like substance. In order to adjust the resistance of the foil that has already been applied, an equalizing groove (not shown herein) can be burnt into the foil transversely to its longitudinal direction by a laser. The insulating body consists of oxide ceramics that possess good thermal conductivity.

In the embodiment shown in FIG. 3 the heating resistor 9 consists of a thick-foil resistor that is connected to the surface of the insulating body that supports it so as to be permanently fixed and thermally conductive.

The third embodiment that is shown in FIG. 4 shows a bimetal switch that has the resistor foil on the side of the insulating body that is furthest from the contact spring. In this switch, it is essential that the foil and the insulating body be so connected as to possess a high level of thermal conductivity.

In the embodiment shown in FIG. 1 and FIG. 2 the insulating body 2 is enclosed at its fixed-contact end 15 by a frame-like carrier 16 on the inner side 17 of which, which is opposite the fixed contact 8, there is a reversing contact surface 18.

On the side of the insulating body 2 that is opposite the resistor foil (heating resistor 9) there is in the middle area a recess 19 that reduces the thermal inertia of the insulating body 2, and this is surrounded by an edge 21 that contributes to the base area 20 of the switch.

FIGS. 3 and 4 also show that in the area of the rivets 11, 22, between the surface of the resistor foil and the surface of the rivet and/or the surfaces of the insulating body there is a layer that is extremely conductive both thermally and electrically, in the form of a conductive silver foil 23.

In the embodiment shown in FIGS. 5 and 6 the insulating body 30 is in the form of a flat rectangular disc that has on its front side 31 the contact spring 32 with the bimetal element 33, and on its rear side 34 has a heating resistor 35 and a further heating resistor 36. The arrangement and contact system of the heating resistor 35 relative to the retaining rivets and the contact spring correspond to the arrangement and the contact system of the heating resistor 9 as in the first drawings. The additional heating resistor 36, that is arranged in parallel to the heating resistor 35 on the rear side 34 of the insulating body 30, is not connected to the contact of the contact spring arrangement 32, but has separate connectors, i.e., the soldering tags 37, that are essentially parallel to the connectors for the heating element 35, which are configured as soldering tags 38. Viewed as a whole, the soldering tag-heating resistor arrangement 38-35-38 on the one hand, and 37-36-37, on the other, form two U-shapes set one inside the other.

As is the case in the embodiment shown in FIGS. 1–4, the connector elements are connected to the insulating body 30 through rivets 39 and are connected by means of conductive silver foil sections 40 with the ends of the associated heating resistors 35 or 36, respectively.

The embodiment of a bimetal switch that is shown in FIGS. 7 and 8 varies from the embodiment shown in FIGS. 5 and 6 essentially in that the insulating body 52 has a heating resistor 50 that consists of a PTC resistor on its rear flat side 53, it being preferred that this PTC resistor be in the form of a cylindrical disc 51, which is to say in the form of a tablet. Two electrical connector elements 54 and 55 are provided on the rear flat side 53 of the insulating body 52 to supply current to this PTC resistor 50, one of these connector elements simultaneously serving to secure the PTC resistor 50. This connector element 54 is preferably in the form of a clip or clamping spring that has in its upper area two inclined arms 56 with hook-shaped sections 57 at their ends, by means of which the upper end of the connector element 54 can be hooked over a corresponding edge of the insulating body 52.

The opposite end of this connector element 54 is connected rigidly to the insulating body 52 by means of a rivet 39. Furthermore, in the area of its clamp or clamping spring this connector element 54 has an area 58 that curves convexly relative to the rear side surface of the insulating body 52 such that when the connector element 54 is secured to the insulating body 52 the PTC resistor 50 can be clamped beneath this curved area 58, so that it is thus in direct contact on the corresponding flat side 53. The other electrical connector element 55 for the PTC resistor 50 can preferably be configured in an essentially L-shape, with one arm of this connector element forming an intermediate layer between the surfaces of the PTC resistor 50 and the surface 53 of the insulating body, which face each other, whereas the other arm of the L-shaped connector element that is at right angles to this is once again connected to the insulating body 52 through a rivet 39.

The direct or practically direct thermal contact of the PTC resistor 50 with the surface 53 of the insulating body is thus ensured by the clamp or clamping spring-like connector element 54, which presses this PTC resistor 50 onto the insulating body 52 or onto the contact surface of the L-shaped second connector element by means of its curved section 58. This second electrical connector element 55 can however be in the form of a conductive silver foil that is applied to the flat side 53 of the insulating body such that this conductive silver foil serves simultaneously as a contact and as a means for transferring heat to the ceramic material of the insulating body 52.

The construction of a thermal relay is made possible with the help of this heating resistor 50 in the form of a PTC resistor; with this, differing temperature and/or differing voltage areas can be detected so as to be reproducible.

FIG. 10 shows an embodiment of a multiple arrangement of bimetal switches, these being configured, for example, as in FIGS. 5 and 6 or as in FIGS. 7 and 8, an insulating carrier 41 being provided in the form of a circuit board on which a plurality of bimetal switches or thermal relays can be installed. To this end, on its surface that is opposite the arrangement of the switches 1 the carrier 41 has conductor strips 60 and 61 (see FIG. 11), with which the electrical connections, which is to say the soldering tags 37 and 38, are connected to the individual switches 1. In particular, there are sockets 62 in the areas of these conductor strips 60 and 61, these extending through the circuit board that forms the carrier and accommodating the corresponding soldering tags 37 and 38 of the switches 1.

Such a use of bimetal switches 1 in the form of a multiple arrangement also makes it possible to construct complex control processes and/or combine various switches 1 to each other in any combination, for example, openers and/or closers, by which means it is possible, for example, to construct warning lights, switching procedures, and the like.

As is also shown in FIG. 11, the conductor strips 60 and 61 are installed on the rear of the carrier 41 such that the heating resistors 35 and 36 are connected in parallel to all the switches 1 that are installed on the carrier 41.

FIGS. 10 and 11 also show that contacts 42, 43 and 44 are also connected with the plate or with the carrier 41, these contacts being in particular angulated and insertable in the corresponding sockets in the plate 41 and being in electrical contact with the conductor strips 60 and 61 so that the whole of the multiple arrangement of bimetal switches connected in parallel can be supplied with current through these contacts 42, 43 and 44.

I claim:

1. A bimetal switch comprising, as the only support member therein, an insulating body fully planar in its expanse and having first and second opposed flat sides, a plurality of electrical connectors supported on said insulating body first flat side, an electrical heating resistor in direct thermal relation with said insulating body and disposed on said first flat side thereof in electrical continuity with said plurality of electrical connectors, and a contact spring having one fixed contact at one end thereof secured to said second flat side of said insulating body and a second end bearing a moving contact, said insulating body supporting a second fixed contact on said second flat side in registry with said moving contact for engagement therewith upon movement thereof, and a bimetal element supported on said contact spring and adapted to move said contact spring responsively to heat generated by said electrical heating resistor.

2. A bimetal switch as defined in claim 1, wherein said electrical heating resistor is configured as a film resistor which forms a laminated body with said insulating body.

3. A bimetal switch as defined in claim 1, wherein said electrical heating resistor is a thin foil resistor.

4. A bimetal switch as defined in claim 1 wherein said electrical heating resistor connects the fixed contact of said contact spring with said second fixed contact.

5. A bimetal switch as defined in claim 1, further including a second electrical heating resistor disposed in parallel with said first-mentioned electrical heating resistor and in direct thermal relation with said insulating body.

6. A bimetal switch as defined in claim 1, wherein the area of the electrical heating resistor is greater than the area of the bimetal element.

7. A bimetal switch as defined in claim 1, wherein said electrical heating resistor is a thin foil resistor having a thickness of approximately 2–20 microns.

8. A bimetal switch as defined in claim 1, wherein the electrical heating resistor has an output of approximately 0.5 W to 15 W.

9. A bimetal switch as defined in claim 1, wherein the electrical heating resistor comprises a PTC resistor.

* * * * *